US009987606B2

(12) United States Patent
Tsai et al.

(10) Patent No.: US 9,987,606 B2
(45) Date of Patent: Jun. 5, 2018

(54) IMPREGNATION APPARATUS AND IMPREGNATION METHOD

(71) Applicant: APAQ TECHNOLOGY CO., LTD., Miaoli County (TW)

(72) Inventors: Cheng-Han Tsai, New Taipei (TW); Kuo-Chen Huang, Chiayi County (TW); Ming-Tsung Liang, New Taipei (TW); Kuan-Chong Wang, New Taipei (TW); Ming-Goo Chien, Taichung (TW)

(73) Assignee: APAQ TECHNOLOGY CO., LTD., Miaoli County (TW)

( * ) Notice: Subject to any disclaimer, the term of this patent is extended or adjusted under 35 U.S.C. 154(b) by 114 days.

(21) Appl. No.: 15/155,148

(22) Filed: May 16, 2016

(65) Prior Publication Data

US 2017/0105900 A1 Apr. 20, 2017

(30) Foreign Application Priority Data

Oct. 14, 2015 (TW) ..... 104133689 A

(51) Int. Cl.
*B01F 13/08* (2006.01)
*B01F 13/10* (2006.01)
(Continued)

(52) U.S. Cl.
CPC ..... *B01F 13/0818* (2013.01); *B01F 13/1072* (2013.01); *B01F 15/00025* (2013.01); *B01F 15/0298* (2013.01); *B08B 1/00* (2013.01)

(58) Field of Classification Search
CPC ..... B01F 13/0818; B01F 13/1072; B01F 15/0298; B01F 15/0487; B01F 15/00019;
(Continued)

(56) References Cited

U.S. PATENT DOCUMENTS 4,725,149 A * 2/1988 Kawakami ..... B01F 13/0818 366/141
5,272,092 A * 12/1993 Hamasaki ..... B01F 11/0005 366/116
(Continued)

FOREIGN PATENT DOCUMENTS

CN 1648333 A 8/2005
CN 102921557 A 2/2013
(Continued)

*Primary Examiner* — Charles Cooley
(74) *Attorney, Agent, or Firm* — Li & Cai Intellectual Property (USA) Office

(57) ABSTRACT

An impregnation apparatus for impregnating a material in a combined medicament. The impregnation apparatus includes a delivery device, a dispensing device, a transmission device, a scraper device, and an impregnation execution device. The combined medicament is poured into a receiving unit by the dispensing device. The scraper device includes a scraper moving unit and a scraper structure arranged on the scraper moving unit. The scraper moving unit drives the scraper structure, leveling the combined medicament in the receiving unit. The impregnation execution device includes a carrying unit and a carrier moving unit. The material is disposed in the carrying unit and is impregnated into the receiving unit carrying the combined medicament by moving the carrying unit. The instant disclosure further provides an impregnation method.

7 Claims, 5 Drawing Sheets

(51) Int. Cl.

| | |
|---|---|
| ***B01F 15/02*** | (2006.01) |
| ***B01F 15/00*** | (2006.01) |
| *B08B 1/00* | (2006.01) |

(58) Field of Classification Search
CPC ..... B01F 15/00025; B01F 15/00032; B01F 15/00058; B08B 1/005; A61J 1/00; A61J 3/00; A61J 7/0076
See application file for complete search history.

(56) References Cited

U.S. PATENT DOCUMENTS

| | | | | |
|---|---|---|---|---|
| 6,905,656 | B1 * | 6/2005 | Ladlow ..... | B01F 13/0818 366/273 |
| 2003/0180755 | A1 | 9/2003 | Hwang et al. | |
| 2010/0122586 | A1 * | 5/2010 | Misu ..... | B01F 11/0266 73/863 |
| 2017/0105900 | A1 * | 4/2017 | Tsai ..... | B01F 13/0818 |

FOREIGN PATENT DOCUMENTS

| | | | | | |
|---|---|---|---|---|---|
| FR | 1200467 | A | * | 12/1959 | ..... B01F 13/0818 |
| GB | 2082929 | A | * | 3/1982 | |
| JP | 2011-62586 | A | | 3/2011 | |
| JP | 2014077773 | A | * | 5/2014 | ..... B01F 9/0014 |
| TW | 293784 | | | 12/1996 | |
| TW | 557277 | | | 10/2003 | |

* cited by examiner

IMPREGNATION APPARATUS AND IMPREGNATION METHOD

BACKGROUND

1. Technical Field

The instant disclosure relates to an impregnation apparatus and an impregnation method, in particular, to an automatic impregnation apparatus and an impregnation method for improving the efficiency of the impregnation process.

2. Description of Related Art

The impregnation processes in the prior art mostly employ manual weight measurement and stirring. However, the time and consistency of the stirring cannot be precisely controlled. In addition, during the impregnation process, the impregnation solution needs to be manually dispersed then the aluminum tray moved upward to impregnate the material into the impregnation solution.

The above process is not able to produce the impregnation solution automatically, and moving the aluminum tray carrying the impregnation solution upward for impregnating the material into the impregnation solution costs a lot of time, significantly reducing the production efficiency.

Therefore, there is a need for providing an impregnation apparatus and an impregnation method to overcome the above disadvantages.

SUMMARY

The instant disclosure provides an impregnation apparatus and an impregnation process for increasing efficiency.

An exemplary embodiment of the present disclosure provides an impregnation apparatus for impregnating a material into a combined medicament, the impregnation apparatus comprises a delivery device, a dispensing device, a transmission device, a scraper device and an impregnation execution device. The delivery device comprises a receiving portion for receiving the dispensing container. The dispensing device is arranged adjacent to the delivery device for pouring-out the combined medicament into a receiving unit. The transmission device is arranged adjacent to the delivery device, in which the receiving unit is arranged on the transmission device. The scraper device is arranged adjacent to the transmission device, the scraper device comprises a scraper moving unit and a scraper structure arranged on the scraper moving unit, the scraper structure is driven by the scraper moving unit and slides on the surface of the combined medicament to level the combined medicament received in the receiving unit. The impregnation execution device is arranged adjacent to the transmission device. The impregnation execution device comprises a carrying unit for carrying the material and a carrier moving unit for moving the carrying unit, in which the carrying unit is driven by the carrier moving unit to impregnate the material positioned on the carrying unit into the receiving unit carrying the combined medicament.

Another exemplary embodiment of the instant disclosure provides an impregnation method for impregnating a material into a combined medicament. The impregnation method comprises the steps of: transmitting a dispensing container to a delivery device; transmitting the combined medicament and a magnetic element into the dispensing container; pouring-out the combined medicament from the dispensing container into a receiving unit; moving the receiving unit carrying the combined medicament to a position beneath a scraper device by a transmission device; leveling the combined medicament in the receiving unit by a scraper structure arranged on the scraper device; moving the receiving unit to a predetermined position by the transmission device for receiving a carrying unit carrying the material; and impregnating the carrying unit carrying the material into the receiving unit carrying the combined medicament.

The advantages of the instant disclosure reside in that the impregnation apparatus and the impregnation method provided by the embodiments of the instant disclosure may be controlled automatically, thereby significantly increasing the efficiency of the process.

In order to further understand the techniques, means and effects of the instant disclosure, the following detailed descriptions and appended drawings are hereby referred to, such that, and through which, the purposes, features and aspects of the instant disclosure can be thoroughly and concretely appreciated; however, the appended drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the instant disclosure.

DESCRIPTION OF THE EXEMPLARY EMBODIMENTS

Figure 1:
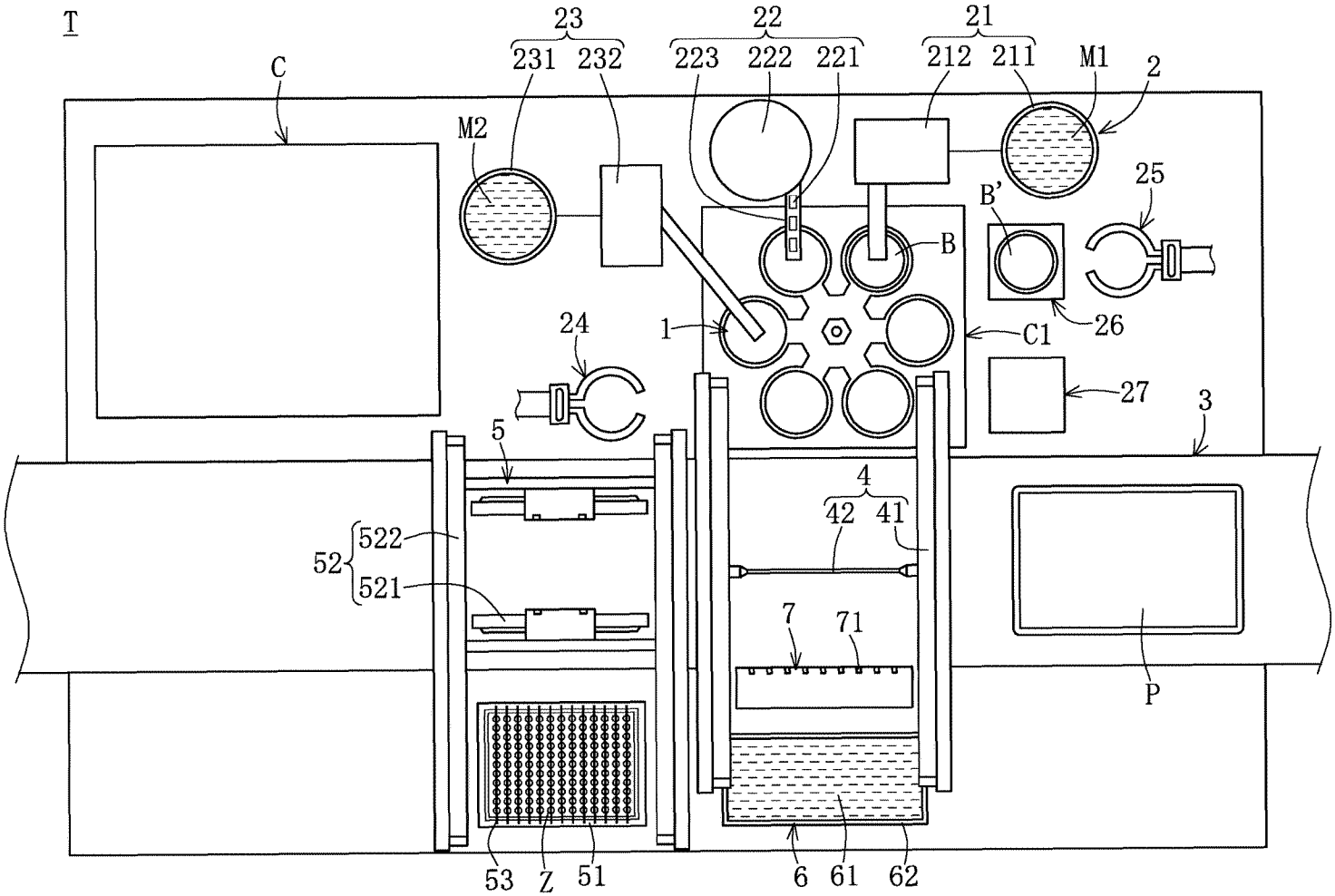
FIG. 1 is a schematic view of the impregnation apparatus of a first embodiment of the instant disclosure.

Reference will now be made in detail to the exemplary embodiments of the instant disclosure, examples of which are illustrated in the accompanying drawings. Wherever possible, the same reference numbers are used in the drawings and the description to refer to the same or like parts.

First Embodiment

Figure 2:
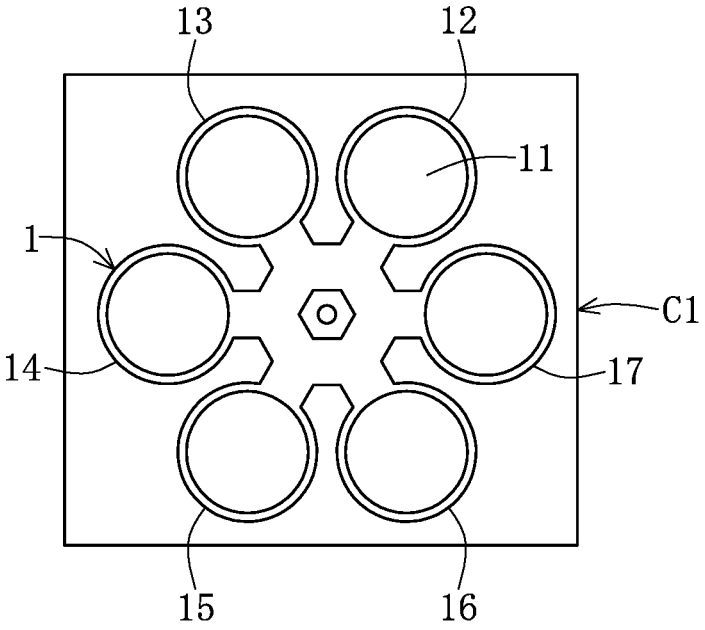
FIG. 2 is a schematic view of the delivery device of the first embodiment of the instant disclosure.

Please refer to FIG. 1 and FIG. 2. The first embodiment of the instant disclosure provides an impregnation apparatus T for impregnating a material Z into a combined medicament M. The impregnation apparatus T comprises a delivery device 1 for delivering a dispensing container B, a dispensing device 2, a transmission device 3, a scraper device 4 and an impregnation execution unit 5. In the embodiments of the instant disclosure, the delivery device 1 has a receiving part 11 for receiving the dispensing container B, and the delivery device 1 can move the dispensing container B by a horizontal rotation plate as shown in FIG. 1 and FIG. 2. However, the instant disclosure is not limited thereto. In other embodiments, the transmission device 3 can be a delivering belt and the moving path of the dispensing container B a linear path.

Next, the dispensing device 2 is arranged adjacent to the delivery device 1 and correspondingly the delivery device 1 pours-out the combined medicament M into a receiving unit P arranged on the transmission device 3 and moved by the transmission device 3. In the embodiments of the instant disclosure, the delivery device 1 comprises a first addition work station 12, a magnetic element supplying work station 13, a second addition work station 14, a medicament pour-out work station 15, a container recycle work station 16 and a discharge work station 17. The dispensing device 2 comprises a container moving unit 25, a first medicament supplying unit 21, a magnetic element supplying unit 22, a second medicament supplying unit 23 and a container moving unit 25. Therefore, the dispensing container B can be sequentially transmitted to each work station for performing each process (such as the medication supplying process). The embodiments of the instant disclosure are able by a container moving unit 25 to first move one of a plurality of dispensing containers B' stacked in the container stacking tank 26 to the first additional work station 12 on the delivery device 1, then perform a follow-up process. For example, the first medicament supplying unit 21 can be arranged adjacent to the first additional work station 12 on the delivery device 1 for transmitting the first medicament M1 into the dispensing container B. Preferably, the first medicament supplying unit 21 comprises a first medicament storage barrel 211 and a first quantometer 212. The first quantometer 212 is connected to the first medicament storage barrel 211 and controlled by a controlling unit (not shown) for titrating a predetermined dose of the first medicament M1 into the dispensing container B. In other words, the user only has to add the first medicament M1 into the first medicament storage barrel 211 and control the controlling unit to automatically titrate the predetermined dose of the first medicament M1 into the dispensing container B.

After the first medicament M1 is titrated into the dispensing container B, the dispensing container B is transmitted to the magnetic element supplying work station 13, and a magnetic element 221 is transmitted into the dispensing container B by the magnetic element supplying unit 22 of the magnetic element supplying work station 13 adjacent to delivery device 1 at the same time. For example, the magnetic element supplying unit 22 may comprise a vibration element 222 and a supplying rail 223. A plurality of magnetic elements 221 moves into the supplying rail 223 by the vibration of the vibration element 222 and moves into the dispensing container B. The magnetic element 221 may be a magnetic bar and rotate by a magnetic stirrer (not shown) arranged on the delivery device 1.

After the magnetic element 221 is transmitted into the dispensing container B, the dispensing container B is transmitted to the second addition work station 14, and a second medicament M2 may be transmitted into the dispensing container B by the second medicament supplying unit 23 of the second addition work station 14 adjacent to the delivery device 1. Preferably, the second medicament supplying unit 23 comprises a second medicament storage barrel 231 and a second quantometer 232. The second quantometer 232 is connected to the second medicament storage barrel 231, and by the control of the controlling unit, a predetermined dose of the second medicament M2 is titrated into the dispensing container B. In other words, the user only has to add the second medicament M2 into the second medicament storage barrel 231, and control the controlling unit to automatically titrate the predetermined dose of the second medicament M2 into the dispensing container B. The dispensing container B comprises the first medicament M1 and the second medicament M2, and the first medicament M1 and the second medicament M2 are mixed by the stirring of the magnetic element 221 and form the combined medicament M. In addition, the delivery device 1 may be arranged in a cooling pool C1 (or a heating pool) for adapting to different temperature environments for different medicaments. The temperature of the cooling pool C1 (or the heating pool) is controlled by a cooler C (or a heater).

After the second medicament M2 is titrated into the dispensing container B, the dispensing container B is transmitted to the medicament pour-out work station 15, and the combined medicament M in the dispensing container B is poured into the receiving unit P by the medicament pour-out unit 24 of the medicament pour-out work station 15 adjacent to the delivery device 1. For example, the medicament pour-out unit 24 may be a mechanical arm or a medicament pour-out mechanism (not shown) arranged on the delivery device 1 for lifting the dispensing container B and pouring-out the combined medicament M.

After the combined medicament M in the dispensing container B is poured into the receiving unit P, the empty dispensing container B may be transmitted to a container recycle work station 16 adjacent to the medicament pour-out work station 15 by the delivery device 1 or the medicament pour-out unit 24. In other words, the container recycle work station 16 is used to receive the dispensing container B which has poured out the combined medicament M. Next, the delivery device 1 transmits the dispensing container B in the container recycle work station 16 to a discharge work station 17 adjacent to the container recycle work station 16 for receiving the dispensing container B from the container recycle work station 16. In addition, a container recycling tank 27 is further provided for collecting the dispensing container B transmitted to the discharge work station 17 to the container recycling tank 27 for a cleaning process.

In the embodiments of the instant disclosure, the dispensing container B is transmitted by the delivery device 1 and sequentially passed through the first additional work station 12, magnetic element supplying work station 13, second additional work station 14, medicament pour-out work station 15, container recycle work station 16 and the discharge work station 17. However, the instant disclosure is not limited thereto. In addition, in other embodiments, the container recycle work station 16 and the discharge work station 17 may be eliminated, i.e., after the combined medicament M in the dispensing container B is poured into the receiving unit P, the dispensing container B is directly transmitted by the delivery device 1 or the medicament pour-out unit 24 to the container recycling tank 27 to wait for further cleaning process.

In addition, in other embodiments, the relative positions between the first additional work station 12, the magnetic element supplying work station 13 and the second additional work station 14 may be changed. The dispensing container B may first pass through the magnetic element supplying work station 13 than enter the first additional work station 12 and the second additional work station 14. However, the instant disclosure is not limited thereto. Furthermore, the dispensing device 2 provided by the embodiments of the instant disclosure may be used in the process of electrolyzing capacitor elements for providing the dispensing process of the capacitor elements during the manufacturing process. In other words, the oxidants, monomers and inhibitors may be added by the first medicament supplying unit 21 and the second medicament supplying unit 23 under quantitation.

The dispensing device 2 provided by the embodiments of the instant disclosure may be used in other medicament processes.

Figure 3:
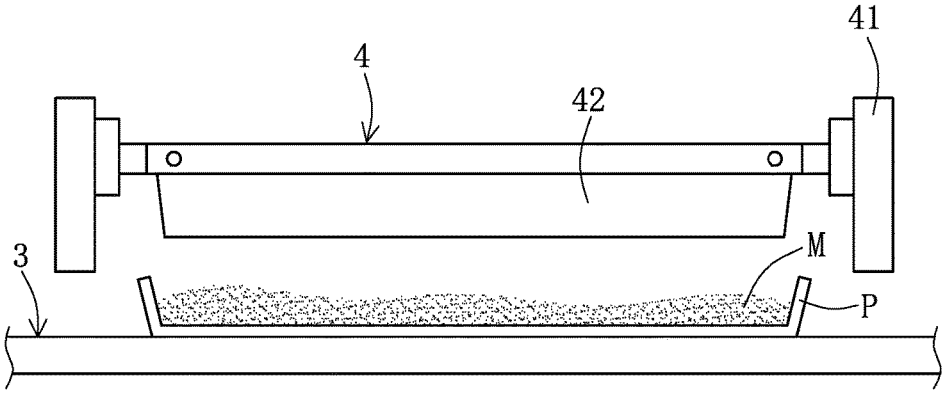
FIG. 3 is a schematic view of the scraper device of the embodiments of the instant disclosure.
Figure 4:
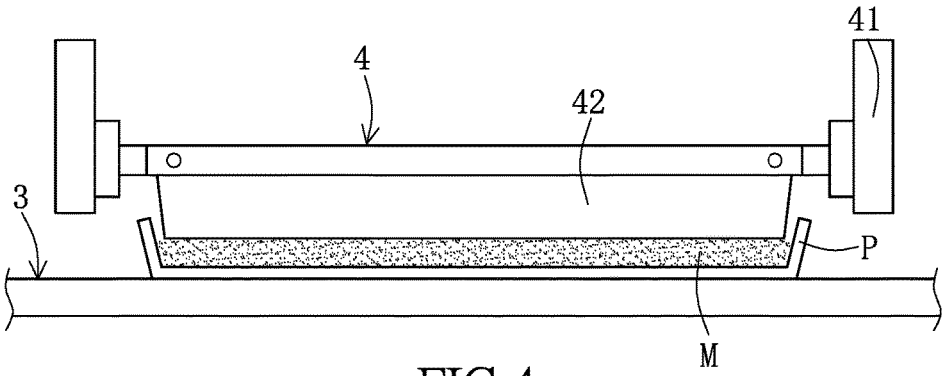
FIG. 4 is another schematic view of the scraper device of the embodiments of the instant disclosure.

Next, please refer to FIG. 3 and FIG. 4. The receiving unit P is arranged adjacent to the transmission device 3 of the delivery device 1. When the combined medicament M is poured into the receiving unit P, the receiving unit P is moved to a position beneath the scraper device 4 by the transmission device 3. Specifically, the scraper device 4 is arranged adjacent to the transmission device 3 and comprises a scraper moving unit 41 and a scraper structure 42 arranged on the scraper moving unit 41. The scraper structure 42 is driven by the scraper moving unit 41 and slide on the surface of the combined medicament M, thereby leveling the combined medicament M in the receiving unit P. Therefore, the combined medicament M in the receiving unit P is dispensed uniformly. Preferably, the scraper moving unit 41 is driven by a server motor and moves upward and downward. In addition, the total quantity of the combined medicament M is determined by the controlling unit for controlling the distance between the scraper structure 42 and the surface of the combined medicament M in the receiving unit P and the moving speed of the scraper structure 42.

Figure 5:
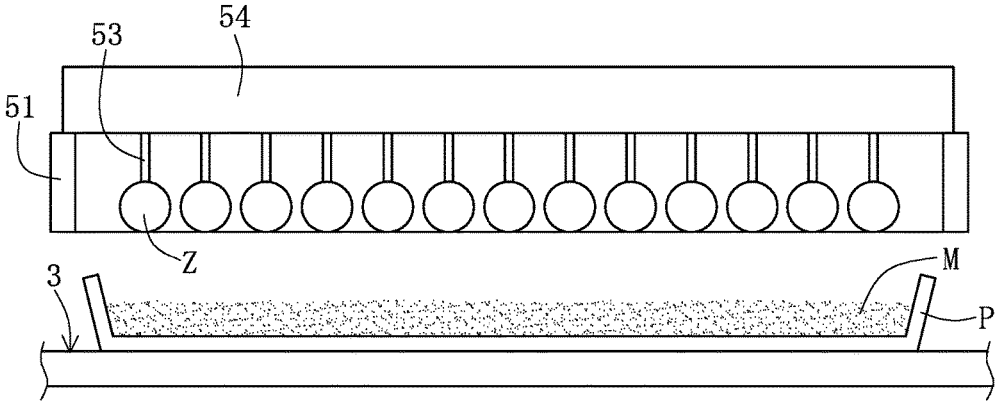
FIG. 5 is a schematic view of the impregnation apparatus of the embodiments of the instant disclosure.

Please refer to FIG. 1 and FIG. 5. After the combined medicament M in the receiving unit P is leveled, the receiving unit P carrying the leveled combined medicament M is transmitted to a position beneath the impregnation execution unit 5 for performing the impregnation process. Specifically, the impregnation execution unit 5 may be arranged adjacent to the transmission device 3 and comprise a carrying unit 51 for carrying the material Z and a carrier moving unit 52 for moving the carrying unit 51. The carrying unit 51 is driven by the carrier moving unit 52 to move upward and downward relative to the surface of the combined medicament M (toward or far away from the surface of the combined medicament M). For example, a material bearing unit (not shown) may be further provided for receiving a plurality of carrying units 51 carrying the material Z. The carrying unit 51 is moved by the carrier moving unit 52 for impregnating the material Z into the receiving unit P carrying the combined medicament M. In other words, the carrying unit 51 is moved into the receiving unit P by the fixture structure 521 and the moving rail 522 on the carrier moving unit 52 for performing the impregnation process. Specifically, in the embodiments of the instant disclosure, the fixture structure 521 is driven by the carrier moving unit 52 and moves laterally, upwardly and downwardly. Therefore, the carrying unit 51 may move laterally from the material bearing to a position above the receiving unit P, and then move downwardly (toward the surface of the combined medicament M) by the fixture structure 521. The carrying unit 51 and the material Z are impregnated into the receiving unit P carrying the combined medicament M for completing the impregnation process.

In addition, for instance, the material Z may be arranged in the carrying unit 51, and a plurality of stopping bars 53 may be arranged above the material Z for fixing the position of the material Z in the carrying unit 51. Preferably, a pressing rod 54 is further arranged above the stopping bar 53 to avoid the material Z from contacting with the combined medicament M during the transportation of the carrying unit 51 by the transmission device 3 influencing the absorbance of the material Z. It is worthwhile to mention that the pressing rod 54 is arranged after performing the impregnation process, or is arranged on the carrying unit 51 before performing the impregnation process. However, the instant disclosure is not limited thereto.

Preferably, a cleaning unit 6 adjacent to the scraper device 4 and a drying unit 7 adjacent to the cleaning unit 6 is further provided. Specifically, the cleaning unit 6 comprises a cleaning tank 62 and a cleaning solution 61 comprised in the cleaning tank 62 for cleaning the combined medicament M remaining on the scraper structure 42. For example, the cleaning solution 61 may be an alcohol solution. However, the instant disclosure is not limited thereto. In addition, the drying unit 7 may comprise a gas injection port 71 for drying the scraper structure 42 by the cleaning unit 6.

Second Embodiment

Figure 6:
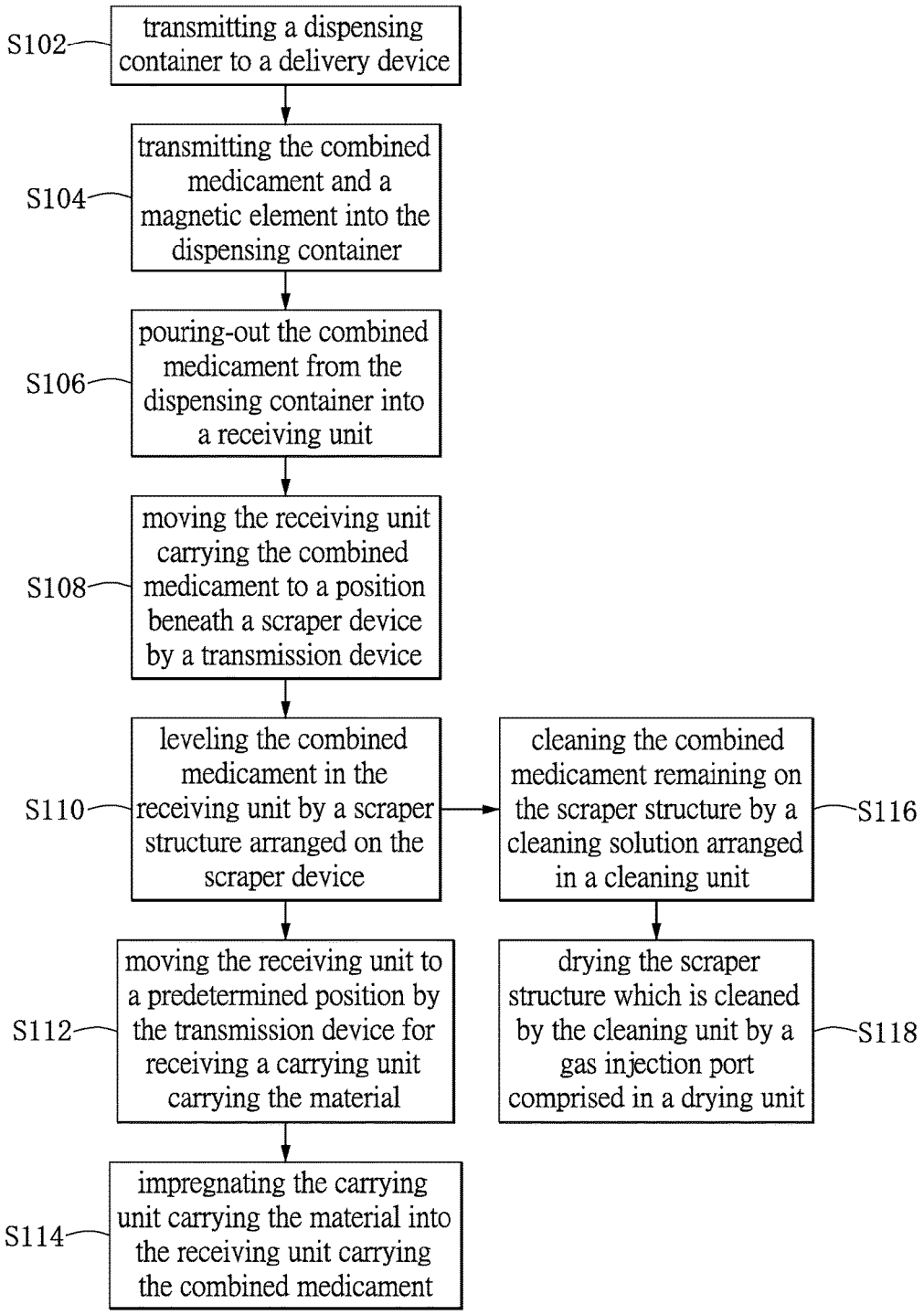
FIG. 6 is the flow chart of the impregnation method of a second embodiment of the instant disclosure.

Please refer to FIG. 1 and FIG. 6. FIG. 6 is the flow chart of the impregnation method of a second embodiment of the instant disclosure. The second embodiment of the instant disclosure provides an impregnation method for impregnating a material Z into a combined medicament M comprising the following steps. As shown in step S102, transmitting the dispensing container B to the delivery device 1. For example, the dispensing container B arranged in the container stacking tank 26 is held or transmitted by a container moving unit 25 to the receiving part 11 of the delivery device 1.

As shown in step S104, the combined medicament M and the magnetic element 221 is transmitted to the dispensing container B. Specifically, step S104 may comprise: transmitting the first medicament M1 and the magnetic element 221 to the dispensing container B, and transmitting the second medicament M2 to the dispensing container B, then uniformly stirring the first medicament M1 and the second medicament M2 by the magnetic element 221 for forming the combined medicament M. In the embodiment of the instant disclosure, the dispensing container B is sequentially transmitted to a position adjacent to the first medicament supplying unit 21, a position adjacent to the magnetic element supplying work station 13 and a position adjacent to the second medicament supplying unit 23 by the delivery device 1 for receiving the first medicament M1, the magnetic element 221 and the second medicament M2 respectively. However, the instant disclosure is not limited thereto. In other words, in other embodiments, the position where the dispensing container B is transmitted to may be selected by a user, i.e., the dispensing container B first transmitted to a position adjacent to the magnetic element supplying unit 22, then to a position adjacent to the first medicament supplying unit 21 and a position adjacent to the second medicament supplying unit 23. Therefore, the first medicament M1 and the second medicament M2 are mixed and stirred by the magnetic element 221 for forming the combined medicament M.

As shown in step S106, the combined medicament M is poured-out from the dispensing container B to a receiving unit P. For example, the receiving unit P is moved to a position adjacent to the medicament pour-out unit 24 by a transmission device 3 for receiving the combined medicament M in a dispensing container B. During the pouring of the combined medicament M, a magnetic adsorb element (not shown) may be used to adsorb the magnetic element 221 for preventing the magnetic element 221 from falling into the receiving unit P.

As shown in step S108, the receiving unit P carrying the combined medicament M is moved to a position beneath the scraper device 4 by a transmission device 3. Next, as shown in step S110, leveling the combined medicament M in the receiving unit P by a scraper structure 42 arranged on the scraper device 4. For example, the scraper structure 42 may be driven by the scraper moving unit 41 and slides back and forth on the surface of the combined medicament M for uniformly dispersing and leveling the combined medicament M in the receiving unit P.

After completing step S110, a step S116 may be further performed for cleaning the combined medicament M remaining on the scraper structure 42 by a cleaning solution 61 in a cleaning unit 6. For example, the scraper structure 42 is immersed into the cleaning solution 61 by the movement of the scraper moving unit 41 and the cleaning solution 61 is an alcohol solution. However, the instant disclosure is not limited thereto. Next, the scraper structure 42 leaves the cleaning solution 61 and is dried by means of step S118: drying the scraper structure 42 cleaned by the cleaning unit 6 by a gas injection port 71 in a drying unit 7, thereby removing the alcohol solution and water remaining on the scraper structure 42 by the drying unit 7.

After the combined medicament M is uniformly dispersed and leveled, the receiving unit P carrying the combined medicament M is moved by the transmission device 3 to a predetermined position for receiving a carrying unit 51 carrying the material Z as shown in step S112. For example, the predetermined position is beneath the impregnation execution unit 5. Next, as shown in step S114, impregnating the carrying unit 51 carrying the material Z into the receiving unit P carrying the combined medicament M. Specifically, the carrying unit 51 and the material Z are held by a fixture structure 521 on a carrier moving unit 52 and impregnated into the combined medicament M in the receiving unit P through the moving rail 522 for performing the impregnation process. Preferably, in the embodiments of the instant disclosure, the carrying unit 51 is driven by the carrier moving unit 52 and moves upward and downward relative to the surface of the combined medicament M for impregnating the material Z into the combined medicament M. Finally, the transmission device 3 transmits the material Z impregnated in the combined medicament M forward for performing other manufacturing processes. The impregnation method provided by the second embodiment of the instant disclosure may be used in conjunction with the devices in the impregnation apparatus T provided in the first embodiment, the elements and devices of the second embodiment are similar to that of the first embodiment and will not be discussed in detail herein.

Effectiveness of the Embodiments

In summary, the impregnation apparatus T and the impregnation method provided by the embodiments of the instant disclosure may be carried out and controlled automatically, thereby increasing the overall manufacturing efficiency of the impregnation process.

In addition, the user only has to regularly add the first medicament M1 and the second medicament M2 to the first medicament storage barrel 211 and second medicament storage barrel 231 rather than perform manual medicament formulations. In other words, the total quantity of the medicament may be accurately controlled by controlling the medicament dose titrated by the first quantometer 212 and second quantometer 232 through the controlling unit. Furthermore, the speed for dispensing the medicament may be significantly increased. Moreover, by the use of the scraper device 4, the combined medicament M is uniformly dispersed. The carrier moving unit 52 may steadily and continuously move the material Z in the carrying unit 51 into the receiving unit P for performing the impregnation process. Therefore, the overall speed of the medicament dispersion and impregnation process is significantly increased and a mass production is achieved.

The above-mentioned descriptions represent merely the exemplary embodiment of the present disclosure, without any intention to limit the scope of the instant disclosure thereto. Various equivalent changes, alterations or modifications based on the claims of the instant disclosure are all consequently viewed as being embraced by the scope of the instant disclosure.

What is claimed is:

1. An impregnation apparatus for impregnating a material into a combined medicament, comprising:

a delivery device for delivering a dispensing container, the delivery device comprises a receiving portion for receiving the dispensing container;

a dispensing device arranged adjacent to the delivery device for pouring-out the combined medicament into a receiving unit;

a transmission device arranged adjacent to the delivery device, wherein the receiving unit is arranged on the transmission device;

a scraper device arranged adjacent to the transmission device, the scraper device comprises a scraper moving unit and a scraper structure arranged on the scraper moving unit, the scraper structure is driven by the scraper moving unit and slides on the surface of the combined medicament to level the combined medicament received in the receiving unit; and an impregnation execution device arranged adjacent to the transmission device, the impregnation execution device comprises a carrying unit for carrying the material and a carrier moving unit for moving the carrying unit, wherein the carrying unit is driven by the carrier moving unit to impregnate the material positioned on the carrying unit into the receiving unit carrying the combined medicament.

2. The impregnation apparatus according to claim 1, wherein the dispensing device comprises:

a first medicament supplying unit arranged adjacent to the delivery device for transmitting a first medicament to the dispensing container;

a magnetic element supplying unit arranged adjacent to the delivery device for transmitting a magnetic element to the dispensing container;

a second medicament supplying unit arranged adjacent to the delivery device for transmitting a second medicament to the dispensing container, wherein the first medicament and the second medicament in the dispensing container are stirred by the magnetic element for forming the combined medicament; and a medicament pour-out unit arranged adjacent to the delivery device for pouring-out the combined medicament from the dispensing container into the receiving unit.

3. The impregnation apparatus according to claim 2, wherein the delivery device further comprises a first additional work station, a magnetic element supplying work station, a second additional work station and a medicament pour-out work station, the first medication supplying unit is arranged adjacent to the first additional work station, the magnetic element supplying unit is arranged adjacent to the magnetic element supplying work station, and the second medicament supplying unit is arranged adjacent to the second additional work station.

4. The impregnation apparatus according to claim 3, wherein the delivery device further comprises a container recycle work station and a discharge work station, the container recycle work station is arranged adjacent to the medication pour-out work station for receiving the dispensing container which has poured-out the combined medicament, and the discharge work station is arranged adjacent to the container recycle work station for receiving the dispensing container from the container recycle work station.

5. The impregnation apparatus according to claim 4, wherein the dispensing container is transmitted by the delivery device and sequentially passes the first additional work station, the magnetic element supplying work station, the second additional work station, the medication pour-out work station, the container recycling work station and the discharge work station.

6. The impregnation apparatus according to claim 4, further comprising a cleaning unit adjacent to the scraper device and a drying unit adjacent to the cleaning unit, wherein the cleaning unit comprises a cleaning solution for cleaning the combined medicament remaining on the scraper structure, the drying unit comprises a gas injection port for drying the scraper structure which is cleaned by the cleaning unit.

7. The impregnation apparatus according to claim 1, wherein the carrying unit is driven by the carrier moving unit and moves upward and downward relative to the surface of the combined medicament.

* * * * *